United States Patent [19]

Glerum

[11] Patent Number: 4,723,681

[45] Date of Patent: Feb. 9, 1988

[54] METALLIC CONTAINER

[75] Inventor: Johannes A. Glerum, Deventer, Netherlands

[73] Assignee: Thomassen & Drijver-Verblifa, Netherlands

[21] Appl. No.: 502,319

[22] Filed: Jun. 8, 1983

[30] Foreign Application Priority Data

Jun. 17, 1982 [NL] Netherlands ..... 8202460

[51] Int. Cl.[4] ..... B65D 8/04

[52] U.S. Cl. ..... 220/72

[58] Field of Search ..... 220/72, 1 R, 1 BC

[56] References Cited

U.S. PATENT DOCUMENTS

| | | | |
|---|---|---|---|
| 1,083,311 | 1/1914 | Weber | 220/72 X |
| 1,262,289 | 4/1918 | Weber | 220/72 |
| 2,685,316 | 8/1954 | Krasno | 229/DIG. 3 X |
| 3,107,989 | 10/1963 | Fesco | 229/DIG. 3 X |
| 3,317,110 | 5/1967 | Palmer | 220/72 X |
| 3,558,001 | 1/1971 | Fritz et al. | 220/72 X |
| 4,169,537 | 10/1979 | Sabreen et al. | 220/72 X |

*Primary Examiner*—Henry J. Recla
*Assistant Examiner*—Robert M. Petrik
*Attorney, Agent, or Firm*—John P. Snyder

[57] ABSTRACT

The invention relates to a metallic container particularly for foodstuff or beverages comprising a circumferential wall, a bottom and a lid, in which container is prevailing a lower pressure than the atmospheric pressure in the filled and closed state.

The invention has for its object to construct a metallic container in a manner such that the desired mechanical strength can be obtained even with a very small wall thickness and hence at very low costs of material.

The invention has furthermore for its object to design a metallic container in a manner such that the probability of undersirable deformation is substantially excluded.

For the above-mentioned purposes the invention provides a metallic container the circumferential wall of which has at least one zone that can be pressed inwards by the effect of the difference between the atmospheric pressure and the pressure inside the container.

9 Claims, 7 Drawing Figures

METALLIC CONTAINER

Figure 2:
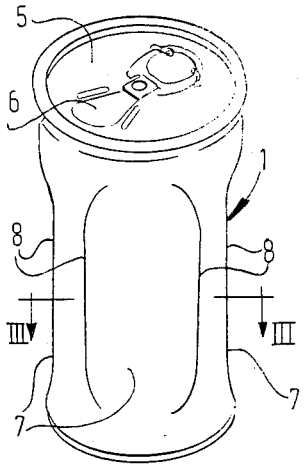

The invention relates to a metallic container particularly for foodstuff or beverages comprising a circumferential wall, a bottom and a lid, in which container is prevailing a lower pressure than the atmospheric pressure in the filled and closed state.

For aerated drinks, for example, thin-walled containers may be used because the internal pressure, which may be higher and even appreciably higher than the atmospheric pressure, imparts sufficient rigidity to the container in the filled and closed state. In those cases in which a pressure lower than the atmospheric pressure prevails in the container in the filled and closed state, for example, when pouring in drinks in a very hot state or when heating the filled container in an autoclave for pasteurisation or sterilisation, a very thin-walled container cannot be employed without the need for special stiffening ridges or the like. Due to the pressure difference resulting from cooling in the closed state in order to ensure sterility the volume of the container tends to decrease, as a result of which the pressure difference between the ambience and the interior of the container decreases. It is known to use a container having a lid bulging outwardly prior to cooling, which lid snaps inwards at a given instant owing to the increasing pressure difference resulting from cooling. Practice has shown that because the periphery of the lid can be deformed only with great difficulty the efforts required for depressing the lid may be so high that the circumferential wall of the container may exhibit considerable deformations without or prior to the desired deformation of the lid. Such a poorly controllable process is undesirable.

The invention has for its object to construct a metallic container in a manner such that the desired mechanical strength can be obtained even with a very small wall thickness and hence at very low costs of material.

The invention has furthermore for its object to design a metallic container in a manner such that the probability of undesirable deformation is substantially excluded. For the above-mentioned purposes the invention provides a metallic container of the kind set forth in the preamble, the circumferential wall of which has at least one zone that can be pressed inwards by the effect of the difference between the atmospheric pressure and the pressure inside the container.

An excellent controllability of the position of the zone is ensured when the or each zone is located between two folding lines extending at least substantially in the direction of length. It is noted here that at the area of the zone the circumferential length of the wall remains substantially the same, whereas nevertheless an appreciable variation in volume occurs, as a result of which the pressure difference between the ambience and the interior of the container decreases as stated above.

The folding lines may correspond to grooves, which may be formed in the inner surface.

As an alternative the folding lines may correspond to narrow zones pressed outwards whilst being deformed plastically or they may be located between relatively parallel narrow zones pressed inwards by plastic deformation.

The drawings show in

Figure 1:
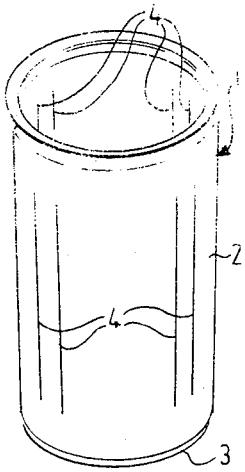
Figure 3:
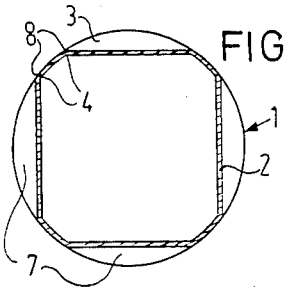
Figure 4:
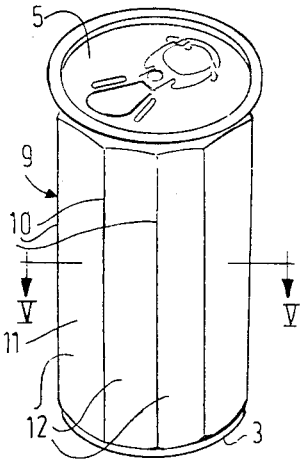
Figure 6:
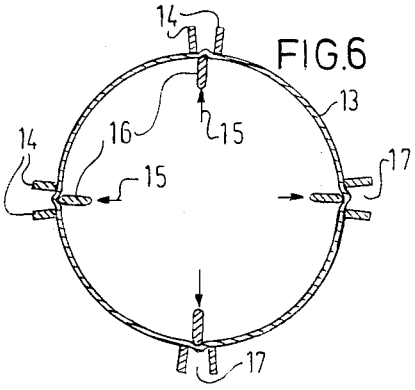
Figure 5:
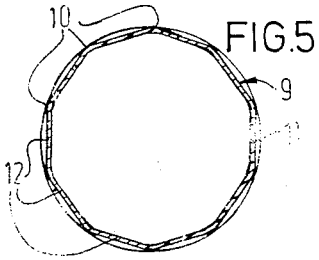
Figure 7:
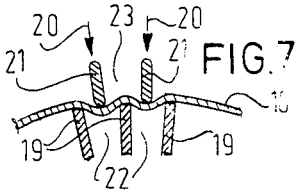

FIG. 1 a container embodying the invention not yet filled,

FIG. 2 the filled, closed and cooled container of FIG. 1,

FIG. 3 a sectional view taken on the line III—III in FIG. 2,

FIG. 4 a perspective view of a further embodiment of the invention,

FIG. 5 a sectional view taken on the line V—V in FIG. 4,

FIG. 6 a schematic cross-sectional view of a further embodiment of the invention during its production phase and FIG. 7 a detail of a variant of FIG. 6.

FIG. 1 is a perspective view of a container 1 not yet filled, comprising a circumferential wall 2 and a bottom 3. On the inner face of the circumferential wall 2 grooves 4 are provided pairwise in the direction of length. The broad zones between the pairs of grooves are relatively readily deformable under the action of a pressure difference between the surroundings and the interior of the container. The narrow zones between the pairs of grooves 4 are deformable only with difficulty.

FIG. 2 shows the container 1 in the filled, hermetically closed, cooled state. A lid 5 with a rip-tag 6 ensures the hermetic closure. From FIG. 2 it will be apparent that in this ready state the container has four inwardly depressed zones 7 bounded by folding lines 8 which correspond to the grooves 4.

FIG. 3 shows a cross-section from which the circumferential shape approximately midway the container is clearly apparent.

It should be noted that the grooves 4 remain at a given distance from the bottom and the lid so that at the top and bottom ends the folding lines 8 are converging and the zones 7 are bounded by contours at a given distance from the bottom 3 and the lid 5.

FIG. 4 shows a container 9 in a design in which ten folding lines 10 in the circumferential wall 11 extend from the bottom 3 to the lid 5. The folding lines 10 and the circumferential edges of the lid 5 and the bottom 3 define ten depressed zones 12.

FIG. 5 shows a cross-sectional view taken on the line V—V in FIG. 4 corresponding to FIG. 3. Clearly apparent is the shape of a regular decagon with slightly rounded-off corners.

It will be obvious that the relative volume variation of the container 9 of FIG. 5 is smaller than that of the container 1 of FIGS. 1, 2 and 3. In general it can be stated that the relative volume variation is the smaller the higher is the number of folding lines.

FIG. 6 shows a container 13 in a stage of the production. It is positioned inside a plurality of annularly grouped anvils 14, which cooperate pairwise with depressing members 16 which can be driven radially to the outside. In the manner shown in FIG. 6 narrow, elongate, outwardly pressed zones 17 plastically deformed in said state are formed, which serve as folding lines. From the description of the foregoing Figures it will be obvious that the container 13 of FIG. 6 obtains a substantially square cross-section.

FIG. 7 shows a container 18, on the inner side of which are disposed a plurality of anvils 19, which cooperate with depressing members 21 which can be driven radially to the inner side in the direction of the arrows 20. In this way inwardly depressed zones 22 are formed, between which extends an undeformed zone 23 serving as a folding line.

Various other forms and designs of the folding lines are possible within the scope of the invention. For example, the folding lines may be inclined with respect to the direction of length so that a helix or part thereof is obtained.

What is claimed is:

1. A metallic container adapted to contain foodstuff under subatmospheric pressure, comprising a generally cylindrical side wall of thin metal, a bottom closing one end of said side wall and a top closing the other end of said side wall, said side wall having a plurality of circumferentially spaced and parallel grooves extending generally longitudinally thereof originating adjacent one end of the side wall and terminating adjacent the other end of the side wall, both ends of each groove terminating in the cylindrical side wall and being connected only through the intervening cylindrical side wall so that panels of the side wall between grooves may deform inwardly due to subatmospheric pressure within the container while the circumferential length of the side wall remains substantially the same.

2. A metallic container as defined in claim 1 wherein certain successive pairs of said grooves are spaced more closely than other successive pairs of said grooves so that said panels are formed only between said other successive pairs of grooves.

3. A metallic container as defined in claim 2 wherein said grooves terminate in substantially spaced relation to said bottom and to said top so that said intervening side wall portions likewise are substantially spaced from said bottom and said top.

4. A metallic container as defined in claim 1 wherein each groove is defined by an outwardly, plastically deformed narrow zone of the side wall.

5. A metallic container as defined in claim 1 wherein each groove is defined by a narrow, undeformed zone of the side wall defined between a pair of inwardly, plastically deformed zones of the side wall.

6. A metallic container as defined in claim 2 wherein each groove is defined by an outwardly, plastically deformed narrow zone of the side wall.

7. A metallic container as defined in claim 2 wherein each groove is defined by a narrow, undeformed zone of the side wall defined between a pair of inwardly, plastically deformed zones of the side wall.

8. A metallic container as defined in claim 3 wherein each groove is defined by an outwardly, plastically deformed narrow zone of the side wall.

9. A metallic container as defined in claim 3 wherein each groove is defined by a narrow, undeformed zone of the side wall defined between a pair of inwardly, plastically deformed zones of the side wall.

* * * * *